US010060097B2

(12) United States Patent
Friend et al.

(10) Patent No.: US 10,060,097 B2
(45) Date of Patent: Aug. 28, 2018

(54) EXCAVATION SYSTEM HAVING INTER-MACHINE MONITORING AND CONTROL

(71) Applicant: Caterpillar Inc., Peoria, IL (US)

(72) Inventors: Paul Russell Friend, Morton, IL (US); Kenneth L. Stratton, Dunlap, IL (US); Michael Edward Brandt, Racine, WI (US); James D. Humphrey, Decatur, IL (US); James William Ryan, Belo Horizonte (BR)

(73) Assignee: Caterpillar Inc., Deerfield, IL (US)

( * ) Notice: Subject to any disclaimer, the term of this patent is extended or adjusted under 35 U.S.C. 154(b) by 234 days.

(21) Appl. No.: 14/987,415

(22) Filed: Jan. 4, 2016

(65) Prior Publication Data

US 2017/0191246 A1 Jul. 6, 2017

(51) Int. Cl.

| | |
|---|---|
| ***G06F 7/70*** | (2006.01) |
| ***G06F 19/00*** | (2018.01) |
| ***G06G 7/00*** | (2006.01) |
| ***G06G 7/76*** | (2006.01) |
| ***E02F 9/26*** | (2006.01) |
| ***E02F 1/00*** | (2006.01) |
| ***E02F 9/24*** | (2006.01) |
| ***E02F 9/20*** | (2006.01) |

(52) U.S. Cl.

CPC ..... *E02F 9/26* (2013.01); *E02F 1/00* (2013.01); *E02F 9/2033* (2013.01); *E02F 9/24* (2013.01); *E02F 9/265* (2013.01)

(58) Field of Classification Search

CPC ..... E02F 9/2045; E02F 9/262

See application file for complete search history.

(56) References Cited

U.S. PATENT DOCUMENTS

| | | | | |
|---|---|---|---|---|
| 8,768,579 | B2 | 7/2014 | Taylor et al. | |
| 8,847,780 | B2 | 9/2014 | Frederick et al. | |
| 9,081,046 | B2 | 7/2015 | Frederick | |
| 2010/0091103 | A1* | 4/2010 | Peltonen | B02C 21/02 348/82 |
| 2012/0074945 | A1* | 3/2012 | Branson | G01V 3/06 324/329 |
| 2012/0098654 | A1 | 4/2012 | Ebert | |
| 2012/0263566 | A1* | 10/2012 | Taylor | E02F 3/437 414/694 |

* cited by examiner

*Primary Examiner* — Imran Mustafa

(74) *Attorney, Agent, or Firm* — Finnegan, Henderson, Farabow, Garrett & Dunner, LLP

(57) ABSTRACT

An excavation system is disclosed for use with an excavation machine having a work tool and with an IPCC. The excavation system may have a location device configured to generate a first signal indicative of a location of the excavation machine, a display, and at least one controller in communication with the location device and the display. The controller may be configured to receive a second signal indicative of a location of the IPCC, and to cause representations of the excavation machine and the IPCC to be simultaneously shown on the display based on the first and second signals. The at least one controller may also be configured to determine a swing radius of the work tool, and to selectively cause an indication of alignment between the IPCC and the swing radius to be shown on the display based on the first signal, the second signal, and the swing radius.

14 Claims, 6 Drawing Sheets

EXCAVATION SYSTEM HAVING INTER-MACHINE MONITORING AND CONTROL

TECHNICAL FIELD

The present disclosure is directed to an excavation system and, more particularly, to an excavation system having inter-machine monitoring and control.

BACKGROUND

Mobile haul vehicles, such as mining trucks and articulated haul trucks, have historically been used to transport ore between different locations at a worksite. For example, the vehicles can be loaded with ore at a first location by an excavation machine (e.g., a rope shovel, a hydraulic shovel, etc.), and transport the ore to a processor (e.g., to a central crusher) at a second location. After processing, the crushed ore is then reloaded onto the mobile haul vehicles and transported to a third location (e.g., to waiting rail cars, to a final use destination, or to a port for loading onto a cargo ship). This method of transporting ore, while useful in some situations, can also require a large crew of skilled operators, a significant amount of fuel, well-maintained roadways, traffic control features, and other costly resources. Traditional ore transportation can also produce a significant amount of noise and air pollution.

Recently, a system of local crushers and conveyors have begun replacing mobile haul vehicles and central crushers at some worksites. These systems are known as In-Pit-Crushing-and-Conveying systems (a.k.a., IPCCs). At worksites employing an IPCC, the excavation machine dumps its material load into a nearby hopper, and the material is funneled down into a local crusher. Crushed material is then deposited by the local crusher onto a proximal end of a primary conveyor belt. The material is transported to a distal end of the primary conveyor belt, where it falls onto a secondary conveyor belt, into a rail car, into a ship, or into or onto another receptacle. In some embodiments, the hopper, crusher, and primary conveyor belt are integral and mobile, such that the location of the hopper and crusher can be continuously adjusted at the dump location for convenient loading by the excavation machine and the distal end of the primary conveyor belt can be strategically positioned over the receptacle.

In most instances, placement of the IPCC is manually controlled, which can be prone to error. For example, if the hopper is not accurately placed on a swing radius of the excavation machine's bucket, the material dumped from the bucket may not land completely inside the hopper. In addition, it may be difficult to determine when the machine's bucket is precisely aligned over the hopper at a desired height, even if the hopper is properly positioned on the swing radius of the excavation machine. Improper hopper positioning and/or misalignment can result in delay, productivity loss, cleanup cost, and equipment damage.

One attempt to address the above-identified issues is disclosed in U.S. Pat. No. 8,768,579 of Taylor et al. that issued on Jul. 1, 2014 ("the '579 patent"). In particular, the '579 patent discloses a system for automating a swing-to-hopper motion of a rope shovel. The system includes a controller that receives position data from sensors for a dipper and for a hopper where materials are to be dumped from the dipper. The controller then calculates an ideal path for the dipper to travel to be positioned above the hopper and dump its contents. The controller outputs operator feedback to assist the operator in traveling along the ideal path to the hopper, restricts dipper motion such that the operator is not able to deviate beyond certain limits of the ideal path, and/or automatically controls the movement of the dipper to reach the hopper.

Although the system of the '579 patent may help an operator to follow an ideal path from a dig location to a dump location, the system may be limited. In particular, the system may do little to help establish the dump location or to avoid collision of the dipper with a poorly positioned dump location. Further, the operator feedback may be difficult to interpret.

The excavation system of the present disclosure is directed towards overcoming one or more of the problems set forth above and/or other problems of the prior art.

SUMMARY

One aspect of the present disclosure is directed to an excavation for use with an excavation machine having a work tool and with an IPCC. The excavation system may include a location device mountable onboard the excavation machine and configured to generate a first signal indicative of a location of the excavation machine, a display, and at least one controller in communication with the location device, and the display. The at least one controller may be configured to receive a second signal indicative of a location of the IPCC, and to cause representations of the excavation machine and the IPCC to be simultaneously shown on the display based on the first and second signals. The at least one controller may also be configured to determine a swing radius of the work tool, and to selectively cause an indication of alignment between the IPCC and the swing radius to be shown on the display based on the first signal, the second signal, and the swing radius.

Another aspect of the present disclosure is directed to another excavation system for use with an excavation machine having a work tool and with an IPCC. This excavation system may include a location device mountable onboard the excavation machine and configured to generate a first signal indicative of a location of the excavation machine, an input device configured to receive input from an operator indicative of a desire to cause swinging of the work tool toward the IPCC, and at least one controller in communication with the location device, and the input device. The at least one controller may be configured to receive a second signal indicative of a location of the IPCC. The controller may also be configured to make a prediction of a trajectory of the work tool during the swinging based on the first signal and known kinematics of the excavation machine, and to determine a potential for collision of the work tool with the IPCC based on the prediction, the second signal, and known kinematics of the IPCC. The at least one controller may also be configured to selectively generate a warning based on the potential.

Yet another aspect of the present disclosure is directed to a method of excavation using an excavation machine having a work tool and using an IPCC. The method may include determining a first location of the excavation machine, receiving a second location of the IPCC, and displaying representations of the excavation machine and the IPCC based on the first and second locations. The method may also include determining a swing radius of the work tool, and selectively displaying an indication of alignment between the IPCC and the swing radius based on the first location, the second location, and the swing radius.

DETAILED DESCRIPTION

Figure 1:
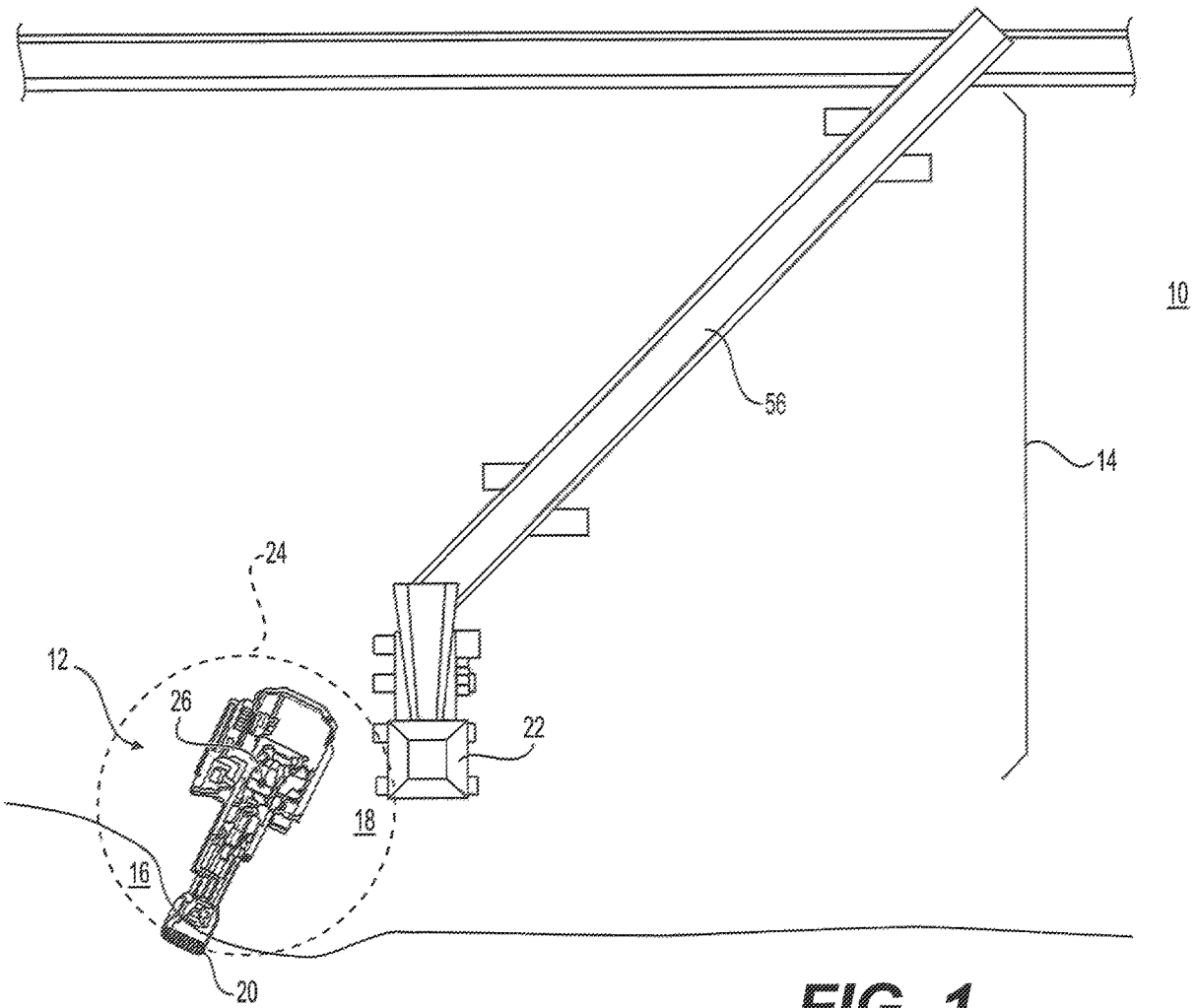
FIGS. 1 and 2 are plan and isometric illustrations, respectively, of an exemplary disclosed worksite.
Figure 2:
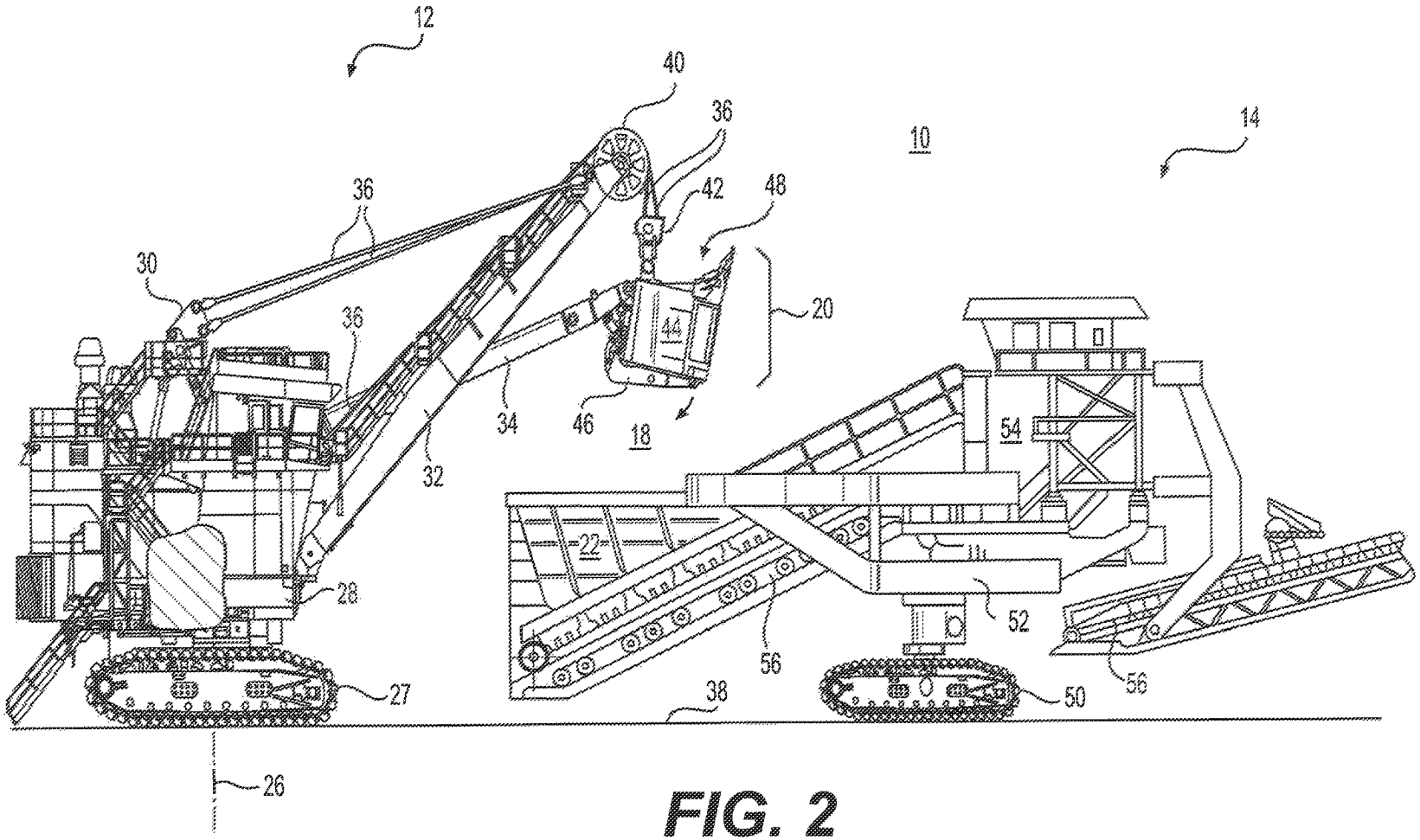

FIGS. 1 and 2 each illustrate an exemplary worksite 10 associated with excavation and transportation of material (e.g., ore). Specifically, worksite 10 is associated with the loading of ore by an excavation machine 12 of material into a mobile IPCC 14. In the disclosed examples, excavation machine 12 is a rope shovel. It is contemplated, however, that excavation machine 12 may be another type of machine, such as a drag line, a hydraulic shovel, or another machine known in the art that is configured to swing between a dig location 16 and a dump location 18 during completion of a repetitive excavation cycle.

During the excavation cycle, excavation machine 12 may scoop fractured ore into a work tool 20 at dig location 16, swing work tool 20 along an arcuate trajectory to dump location 18, dump the ore into a hopper 22 of IPCC 14, and return back to dig location 16 via reverse travel along the same general arcuate trajectory (although elevation may vary between swings, based on loading). The arcuate trajectory may lie along a swing radius 24 of work tool 20 that is located at a fixed distance away from a swing axis 26 of excavation machine 12. When hopper 22 is centered on swing radius 24 and work tool 20 is angularly aligned over hopper 22 when the ore is dumped from work tool 20, a majority of the ore in work tool 20 will fall into hopper 22. Positioning hopper 22 off the swing radius and/or misalignment of work tool 20 over hopper 22 may result in spillage of the ore. And even when hopper 22 is positioned on the swing radius of work tool 20, when hopper 22 is not located at a desired angular orientation, the resultant swinging of work tool 20 may be inconvenient and/or inefficient. Accordingly, care should be taken to properly position and orient IPCC 14 relative to excavation machine 12 before start of the excavation cycle.

As shown in FIG. 2, excavation machine 12 may include a crawler 27, a base 28 operatively connected to crawler 27, and a gantry 30 rigidly mounted to a top side of base 28 opposite crawler 27. Excavation machine 12 may also include a boom 32 pivotally connected to a leading end of base 28, a dipper handle 34 pivotally connected between a midpoint of boom 32 and work tool 20, and one or more wire ropes or cables 36 connecting boom 32 and/or work tool 20 to gantry 30 and/or base 28. It should be noted that other excavation machine configurations may be possible.

Crawler 27 may be a structural unit that supports movements of excavation machine 12. In the disclosed exemplary application, crawler 27 is itself movable, having one or more traction devices such as feet, tracks, and/or wheels that are driven to propel excavation machine 12 over a ground surface 38. In other applications, however, crawler 27 may be replaced with a stationary platform configured for fixed engagement with ground surface 38.

Base 28 may pivot relative to crawler 27 about swing axis 26. As base 28 is pivoted about axis 26, attached gantry 30, boom 32, dipper handle 34, work tool 20, and/or cables 36 may likewise pivot to change a radial engagement angle of work tool 20 with ground surface 38 and with IPCC 14. Base 28 may house, among other things, a power source (e.g., a combustion engine—not shown) and an internal drum (e.g., a hoist drum, a drag drum, etc.—not shown) that is driven by the power source.

Gantry 30 may be a structural frame, for example a general A-shaped frame, which is configured to anchor one or more of cables 36 to base 28. Gantry 30 may extend from base 28 in a vertical direction away from crawler 27. Gantry 30 may be located rearward of boom 32 relative to work tool 20 and, in the disclosed exemplary embodiment, fixed in a single orientation and position. Portions of cables 36 may extend from an apex of gantry 30 to a distal end of boom 32, thereby transferring a weight of boom 32, work tool 20, and a load contained within work tool 20 into base 28.

Boom 32 may be pivotally connected at a lower end to base 28, and constrained at a desired vertical angle relative to ground surface 38 by one or more additional cables 36. Other cables 36 may extend from the drum over a pulley mechanism 40 located at a distal end of boom 32 and around a corresponding pulley mechanism 42 of work tool 20. These cables 36 may be selectively reeled-in and spooled-out by the drum to affect the height and vertical angle of work tool 20 relative to ground surface 38.

Dipper handle 34 may be pivotally connected at one end to a general midpoint of boom 32, and at an opposing end to an edge of work tool 20 adjacent pulley mechanism 42 (e.g., rearward of pulley mechanism 42). In this position, dipper handle 34 may function to maintain a desired distance of work tool 20 away from boom 32 and ensure that work tool 20 moves through a desired vertically oriented arc as the effective lengths of cables 36 change. In some configurations, dipper handle 34 may be provided with a crowd cylinder (not shown) that functions to extend or retract dipper handle 34. In this manner, the distance between work tool 20 and boom 32 (as well as the vertical and horizontal arcuate trajectories of work tool 20) may be adjusted. It should be noted that other linkage configurations may additionally or alternatively be used to connect work tool 20 to base 28, if desired.

Work tool 20, in the disclosed embodiment, is known as a dipper. A dipper is a type of shovel bucket having a dipper body 44, and a dipper door 46 located at a back side of dipper body 44 opposite a front side excavation opening 48. Dipper door 46 may be hinged along a base edge at the back side of dipper body 44, so that it can be selectively pivoted to open and close dipper body 44 during an excavating operation. Dipper door 46 may be pivoted between the opened and closed positions by gravity, and held closed or released by way of a dipper actuator (not shown). For example, when work tool 20 is lifted upward (shown in FIG. 2) toward the distal end of boom 32 by reeling in of cables 36, a releasing action of the dipper actuator may allow the weight of dipper door 46 (and any material within work tool 20) to swing dipper door 46 downward away from dipper body 44. This motion may allow material collected within work tool 20 to spill out the back side. In contrast, when work tool 20 is lowered toward ground surface 38, the weight of dipper door 46 may cause dipper door 46 to swing back toward dipper body 44. The dipper actuator may then be caused to lock dipper door 46 in its closed position.

IPCC 14 may include conventional components used to position and orient itself, to receive ore from excavation machine 12, to process the ore, and to transport the ore to a desired location. Many different configurations of components may be available for use with IPCC 14, and the selection of the components may be at least partially dependent on the ore being excavated by machine 12, the process being performed on the ore, and parameters (e.g., distance, speed, terrain, etc.) associated with the transportation. In the disclosed example, IPCC 14 includes, among other things, a crawler 50, a base 52 connected to crawler 50, hopper 22 supported by base 52, a processor 54 located to receive ore from hopper 22, and one or more conveyors 56 configured to transport material between hopper 22 and processor 54 and/or away from processor 54. It is contemplated that, in some embodiments, processor 54 may be omitted, if desired. In particular, the material being deposited into hopper 22 by excavation machine 12 could be funneled directly onto conveyor 56, if desired.

Crawler 50, like crawler 27 of excavation machine 12, may be a structural unit that supports movements of IPCC 14. In the disclosed exemplary application, crawler 50 has one or more traction devices such as feet, tracks, and/or wheels that are driven to propel IPCC 14 over ground surface 38. It is contemplated that the traction devices may be electrically driven, hydraulically driven, and/or mechanically driven by an onboard power source (not shown), as desired.

Base 52 may be fixedly or movable (e.g., pivotally) connected to crawler 50. Accordingly, movement of crawler 50 may result in corresponding movements of base 52, or one or more actuators may be disposed between crawler 50 and base 52 and configured to translate and/or pivot base 52. Base 52 may house, among other things, the power source (e.g., a combustion engine—not shown) that powers crawler 50, any actuators that are present, and/or motors associated with conveyors 56.

Hopper 22 may be secured to base 52 at a location gravitationally above processor 54 and/or above a conveyor 56 that transports the ore from hopper 22 to processor 54. Hopper 22 may embody a funnel-type container for receiving ore discharged from work tool 20 and depositing the ore in a concentrated manner into processor 54 and/or onto conveyor 56. In particular, an upper opening of hopper 22 may flare or bevel outward to capture a wide spray of the falling ore, and a lower opening of hopper 22 may taper inward to concentrate the discharging ore. In some embodiments, hopper 22 may include an integral vibrator (not shown) that helps to efficiently move the ore from the upper opening to the lower opening.

Processor 54 may include any type of processing apparatus known in the art. In one example, processor 54 includes a crusher. In another example, processor 54 includes a grinding mill. In yet another example, processor 54 includes a sieve or a vibration table. It is contemplated that other or additional types of processing apparatus may be included within processor 54, if desired. As the ore passes through processor 54, a desired process may be performed on the ore prior to the ore being deposited on a proximal end of conveyor 56.

Conveyor 56 may utilize conventional components known the art to transport material from hopper 22 to processor 54 and/or away from processor 54 to another conveyor 56, to a haul truck, to a rail car, to a final-use destination, to a cargo ship, etc. In the disclosed embodiment, conveyor 56 is elevated off ground surface 38 by base 52 and crawler 50. In one embodiment, conveyor 56 is fixed to base 52. In another embodiment, conveyor 56 may be configured to pivot or otherwise move relative to base 52. For example, conveyor 56 could be provided with one or more actuators (not shown) that may be used to lift, pivot, and/or tilt conveyor 56. One or more stationary or mobile supports (not shown) may be located along a length of conveyor 56, as needed.

Figure 3:
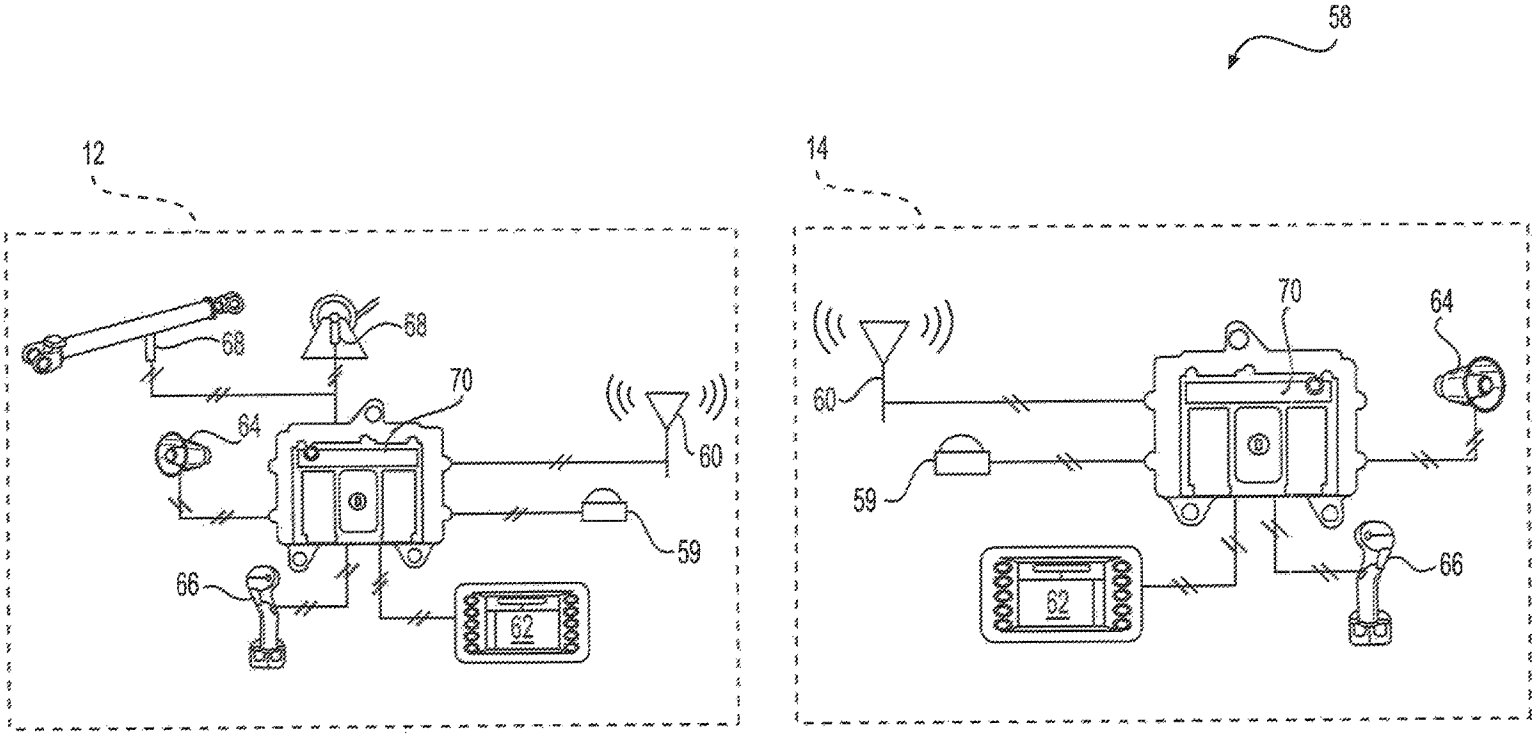
FIG. 3 is a diagrammatic illustration of an exemplary disclosed excavation system that may be used at the worksite of FIGS. 1 and 2.

An excavation system ("system") 58 may be associated with excavation machine 12 and IPCC 14, and used to coordinate movements and activities of both machines. As shown in FIG. 3, system 58 may include components located onboard excavation machine 12 and onboard IPCC 14 that communicate with each other. These components may include, among other things, a location device 59, a communication device 60, a display 62, a warning device 64, and an input device 66. In addition, system 58 may include one or more sensors 68 located onboard only one or both of excavation machine 12 and IPCC 14, and a controller 70 connected to each of the other onboard components. As will be explained in more detail below, controllers 70 may be configured to provide maneuvering recommendations, display relative machine positions, generate warnings, and/or automatically control operations of excavation machine 12 and/or IPCC 14 based on known kinematics of both machines and based on signals generated by location device 59, communication device 60, input device 66, and sensors 68.

Location device 59 may be configured to generate signals indicative of a geographical position and/or orientation of the associated machine (i.e., of excavation machine 12 or IPCC 14) relative to a local reference point, a coordinate system associated with a region, a coordinate system associated with Earth, or any other type of 2-D or 3-D coordinate system. For example, location device 59 may embody an electronic receiver configured to communicate with satellites or with a local radio or laser transmitting system and to determine a relative geographical location of itself. Location device 59 may receive and analyze high-frequency, low-power radio or laser signals from multiple locations to triangulate a relative 3-D geographical position and orientation. Signals generated by location device 59 may be directed to controller 70 for further processing.

Communication device 60 may be configured to facilitate data communication between different components (e.g., between controllers 70, between controller 70 and display 62, and/or between controller 70 and another offboard controller at a back office) of system 58. Communication device 60 may include hardware and/or software that enable the sending and/or receiving of data messages through a communications link. The communications link may include satellite, cellular, infrared, radio, and any other type of wireless communications. Alternatively, the communications link may include electrical, optical, or any other type of wired communications, if desired. In one embodiment, display 62 and/or controller 70 may be located offboard (e.g., at the back office), and may communicate directly with the other onboard components of system 58 via communication device 60, if desired. Other means of communication may also be possible.

Display 62 may include one or more monitors (e.g., a liquid crystal display (LCD), a cathode ray tube (CRT), a personal digital assistant (PDA), a plasma display, a touch-screen, a portable hand-held device, or any such display device known in the art) configured to actively and responsively show relative machine positions, recommendations, warnings, payloads, etc. to the operator of the associated machine. Display 62 is typically disposed in close proximity to the cabin of the associated machine and within the view of the operator. However, as described above, display 62 could be located offboard, in one embodiment. Display 62 may be connected to controller 70, and controller 70 may execute instructions to render graphics and images on display 62 that are associated with interrelated operations of excavation machine 12 and IPCC 14.

In the disclosed example, a single audible-type warning device 64 is included on each of excavation machine 12 and IPCC 14. It is contemplated, however, that any number and/or type of warning device 64 may be used. For example, a visual warning device (not shown) and/or a tactile warning device may additionally or alternatively be included. Warning device 64 may be located anywhere on or in the associated machine and, when activated by controller 70, alert the operator of a current or anticipated event.

Input device 66 may be configured to receive input from a machine operator indicative of a desired machine operation. Any number of input devices 66 may be located proximate an operator seat and be movable to produce displacement signals that are indicative of a desired machine maneuver (e.g., swinging or dumping movements), a desired mode of operation, a desired function (e.g., override function), etc. Input devices 66 may include joysticks, levers, pedals, buttons, and switches, among others. Signals generated by input devices 66 may be directed to controllers 70 for further processing.

Any number of sensors 68 may be included within system 58, and associated with any component and function of any machine. For example, one or more sensors 68 could be associated with the components supporting the movement of work tool 20 (e.g., with base 28, gantry 30, boom 32, dipper handle 34, cables 36, the drum, the crowd cylinder, dipper door 46, the door actuator, etc.) and configured to generate signals corresponding to a position, an extension, an angle, a pressure, a load, a weight, a speed, etc. In another example, one or more sensors 68 could be associated with crawler 27 and/or crawler 50, with hopper 22, with processor 54, with conveyor 56, etc., and configured to generate corresponding signals indicative of the performances of the associated components. The signals generated by sensors 68 may be directed to the associated one or both of controllers 70 for further processing.

Each controller 70 may embody a single or multiple microprocessors, field programmable gate arrays (FPGAs), digital signal processors (DSPs), etc., that include a means for controlling operations of system 58 in response to operator input, built-in constraints, and sensed or communicated information. Numerous commercially available microprocessors can be configured to perform the functions of these components. Various known circuits may be associated with these components, including power supply circuitry, signal-conditioning circuitry, actuator driver circuitry (i.e., circuitry powering solenoids, motors, or piezo actuators), and communication circuitry.

Each controller 70 may be configured to determine a payload of the associated machine, and to cause a representation of the payload to be shown on the corresponding display 62. In particular, based on signals (e.g., pressure signals, strain signals, image signals, deflection signals, etc.) from one or more sensors 68 (e.g., sensors associated with work tool 20, boom 32, cables 36, the drum, tool actuators, etc.), controller 70 located onboard excavation machine 12 may be configured to determine a weight, volume, and/or distribution of material loaded inside work tool 20. In similar manner, based on signals (e.g., pressure signals, strain signals, image signals, deflection signals, etc.) from one or more sensors 68 (e.g., sensors associated with hopper 22, processor 54, conveyor 56, etc.), controller 70 located onboard IPCC 14 may be configured to determine a weight and/or volume of material loaded therein.

Figure 4:
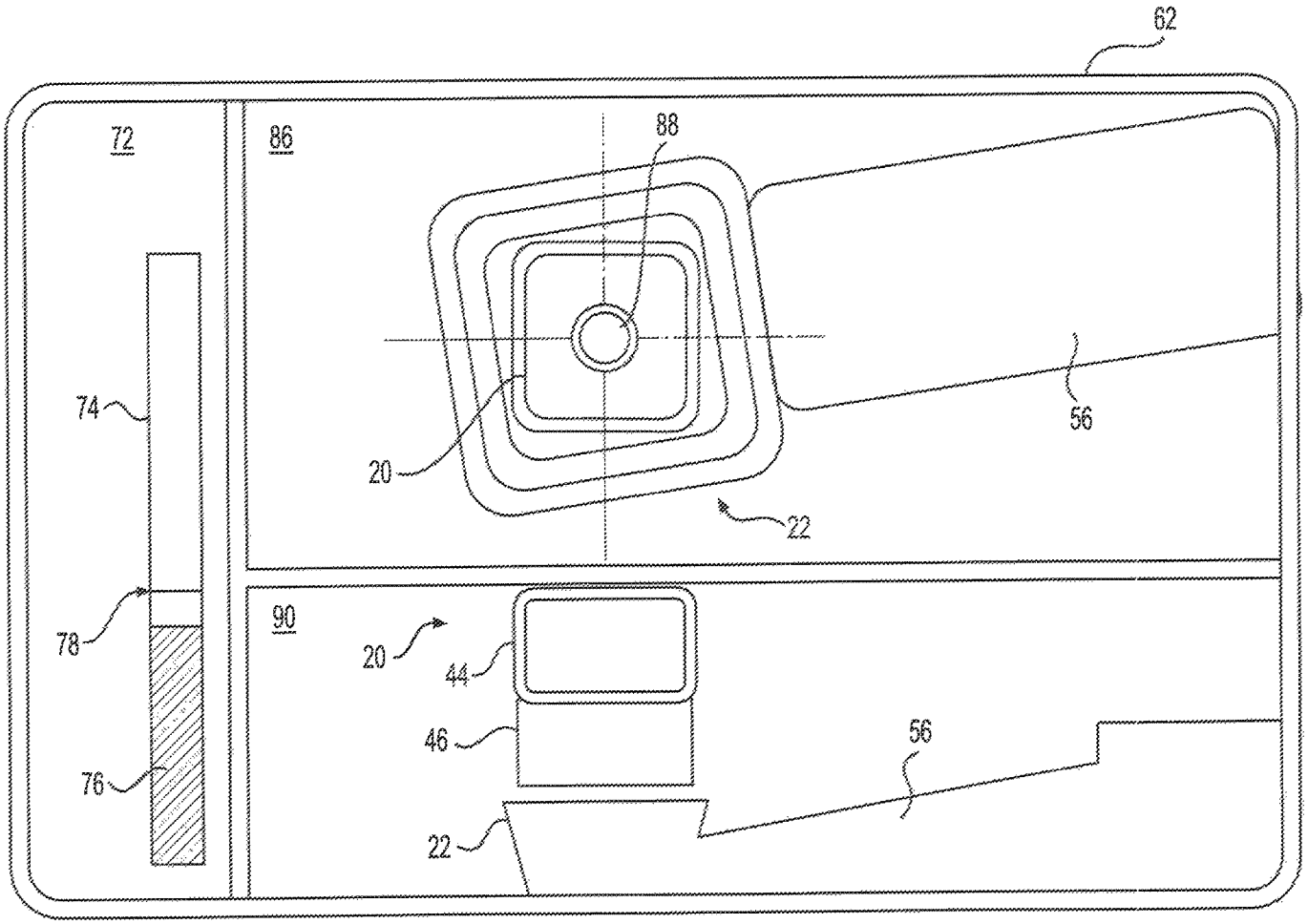
FIGS. 4 and 5 are exemplary disclosed displays that may form portions of the excavation system of FIG. 3.

In some embodiments, the loading of excavation machine 12 and/or IPCC 14 may be shown on the associated display 62 inside the corresponding machine. For example, in the exemplary display 62 shown in FIG. 4, a left most section 72 illustrates a loading status of hopper 22. In particular, a vertical bar 74 represents a capacity of hopper 22 to hold material, while a lower shaded portion 76 of vertical bar 74 represents an estimate of a current amount of material inside hopper 22. In addition, an arrow and/or horizontal line 78 passing through vertical bar 74 represents an estimate of how much the next load of material dumped from work tool 20 will increase the amount of material inside hopper 22. Although display 62 shown in FIG. 4 is intended for use in excavation machine 12, the same or another payload representation may be included on either or both of displays 62.

In some embodiments, the payload information associated with one machine may be communicated to the other machine via communication devices 60. For example, the payload information associated with excavation machine 12 may be selectively communicated to IPCC 14 each time that a load of material is dumped from work tool 20 into hopper 22. This may allow IPCC 14 to estimate the amount of material currently inside hopper 22, without having to monitor or otherwise measure the loading of hopper 22. For example, based on a known amount of material dumped into hopper 22 and a known or measured speed of conveyor 56 (and an assumed or calculated rate of material transfer out of hopper 22 by conveyor 56), controller 70 of IPCC 14 may be able to determine an amount of material (and/or a shape, volume, or distribution of material) inside of hopper 22. In another example, the determined or measured amount of material (and/or shape, volume, or distribution) inside hopper 22 may be used to make decisions regarding the loading of hopper 22 by excavation machine 12. For example, when the amount of material inside hopper 22 is greater than or less than a threshold amount, controller 70 of either machine may determine if more or less material should be dumped into hopper 22, and when. Corresponding instructions may then be shown on display 62 inside excavation machine 12. For example, an instruction may be sent indicating when hopper 22 is ready to receive a next load of material and/or where inside hopper 22 the material should be dumped. In this way, hopper 22 may be productively utilized without the risk of overloading.

Controllers 70 may also cooperate to help position and/or orient the corresponding machines with each other in preparation for execution of the repetitive excavation cycle. As stated above, hopper 22 of IPCC 14 should be centered on swing radius 24 (referring to FIG. 1) of work tool 20 in order for the most efficient transfer of material to occur. Swing radius 24 of work tool 20 may be different for each excavation machine 12, for each type of excavation machine 12, and/or for each configuration of excavation machine 12. In addition, swing radius 24 may change during operation of excavation machine 12 based on loading, based on spooled out lengths of cables 36, based on use of the crowd cylinder (if present), etc.

Figure 5:
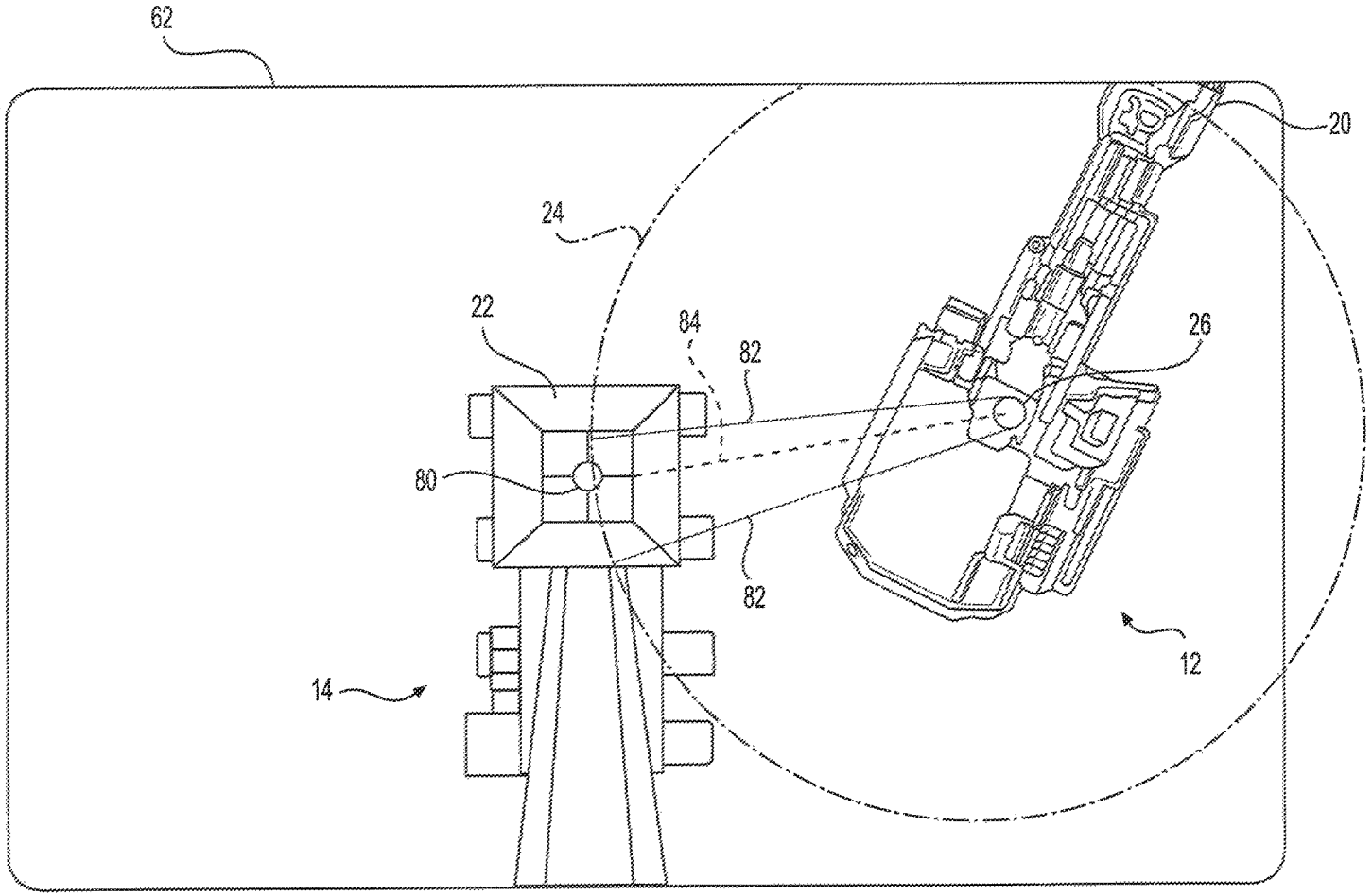

Accordingly, controller 70 of excavation machine 12 may be configured to determine the current swing radius 24 of excavation machine 12 based on signals from one or more sensors 68 and/or based on known kinematics of excavation machine 12. This information may then be passed via communication devices 60 between controllers 70, and shown on display 62 of IPCC 14. For example, as shown in FIG. 5, a representation of excavation machine 12 is displayed at a known position relative to IPCC 14. In addition, a dashed circle centered about axis 26 and passing through a center of work tool 20 is shown on display 62 and represents swing radius 24 of work tool 20.

Further, representation of hopper 22 shown in display 62 may be configured to change based on general alignment of hopper 22 with swing radius 24. For example, a center (or another portion) 80 of hopper 22 may change in color, change in light intensity, change in texture or shading, or change in another manner to represent a proximity of hopper 22 to swing radius 24 of work tool 20. In the disclosed embodiment, center 80 of hopper 22 may be filled with a red color when hopper 22 is not aligned with the swing radius, filled with a yellow color when partially aligned, and filled with a green color when properly aligned.

In addition, there may be times when a particular point on swing radius 24 of work tool 20 is better suited for hopper loading than another point. This particular point may be determined as a function of swing angle, terrain, operator view, swing acceleration/deceleration durations, fuel efficiency, and other factors known in the art. The particular point may be automatically determined by controller 70 of excavation machine 12 or determined and set manually by the operator of excavation machine 12. In either situation, the particular point (or a range bounding the particular point) may be communicated to IPCC 14 and shown on the corresponding display 62. This representation is illustrated in FIG. 5 as one or more lines (e.g., two boundary lines 82 and one dashed center line 84) that extend from swing axis 26 of excavation machine 12 through swing radius 24.

Lines 82 and/or 84 that are shown on display 62 and used to designate the ideal or desired hopper loading point may be used by the operator of IPCC 14 to position IPCC 14. For example, the operator may initiate movements of crawler 50 that cause hopper 22 to shift between boundary lines 82 and/or into general alignment with center line 84. In some embodiments, the representation of IPCC 14 shown in FIG. 5 may change when hopper 22 is properly aligned with the ideal hopper loading point. For example, when the ideal hopper loading point has been designated and center 80 of hopper 22 has been moved to align with swing radius 24 of work tool 20 but not yet aligned with the ideal hopper loading point on center line 84, center 80 of hopper 22 shown in display 62 may be filled with the yellow color. In this same example, only when center 80 of hopper 22 is aligned with both swing radius 24 and the ideal loading point on center line 84, will center 80 of hopper 22 be filled with the green color. And center 80 of hopper 22 may be filled with the red color when neither alignment is achieved. In some embodiments, warning device 64 may be active any time that center 80 of hopper 22 is filled with the red color.

One or both of controllers 70 may also be configured to determine when a collision between machines may occur, and to alert the operator of such a potential. In particular, during swinging of excavation machine 12 about axis 26, opportunity exists for two portions of excavation machine 12 to collide with IPCC 14. Specifically, it may be possible for work tool 20 to collide with IPCC 14 and/or for a back end of base 28 (e.g., a counterweight portion) to collide with IPCC 14. Accordingly, during positioning of excavation machine 12 and/or IPCC 14, controller 70 of each machine may determine (e.g., based on signals from location devices 59) the positions of each machine. In addition, each controller 70 may be configured to determine the locations of particular features and/or components of each machine based on the determined machine positions and known kinematics of each machine. Either or both of controllers 70 may then determine if swinging of excavation machine 12 at its current relative location could result in collision of base 28 or work tool 20 with any portion (e.g., hopper 22) of IPCC 14. If collision is likely for the given locations and loading conditions of the machines, a corresponding warning may be generated. For example, warning device 64 may be selectively activated to produce an audible warning, and/or a visual warning may be shown on one or both of displays 62. The visual warning may include a change in the representation of hopper 22 shown in display 62 of FIG. 5. For example, the beveled upper end surfaces of hopper 22 may be filled with the red color, and remain this color until the relative positions of the machines is changed.

Even once IPCC 14 is properly positioned, with center 80 of hopper 22 on swing radius 24 of work tool 20 at the ideal loading point (i.e., in alignment with center line 84), and no collision is determined to be likely during swinging, it may still be important to control excavation machine 12 during each iteration of the excavation cycle to correctly bring work tool 20 to rest at a desired elevation over the top of hopper 22 before opening dipper door 46. In particular, it may still be possible for the operator of excavation machine 12 to swing work tool 20 too little or too far, resulting in spillage from work tool 20. In addition, it may also be possible for the operator to have lowered work tool 20 too low, such that dipper door 46 collides with hopper 22 after work tool 20 comes to a rest above hopper 22 and begins to open and dump. For this reason, controller 70 of excavation machine 12 may be configured to show dynamic placement of work tool 20 over hopper 22 on display 62 inside of excavation machine 12. For example, as shown in FIG. 4, an upper right section 86 may show a birds-eye view of work tool 20 over the top of hopper 22. In some embodiments, a center 88 of work tool 20 may be shown differently based on the general vertical alignment of work tool 20 with hopper 22. For example, center 88 may be shown in green when the alignment is proper for dumping to commence, shown in yellow during partial alignment, and shown in red during misalignment that will result in spillage. A lower-right section 90 of display 62 shown in FIG. 4 may show this same relative alignment between work tool 20 and hopper 22, but from a side- or end-view perspective.

In addition, lower right section 90 of display 62 may represent an elevation of work tool 20 and/or dipper door 46 above hopper 22. For example, dipper door 46 may be shown connected to dipper body 44 and oriented in its open position below dipper body 44. When work tool 20 is low and too close to hopper 22 (i.e., close enough that dipper door 46 would collide with hopper 22 when moved to its open position), the representation of dipper door 46 may be filled with the red color. When work tool 20 is even lower relative to hopper 22, and a collision between dipper body 44 and hopper 22 may occur during swinging, dipper body 44 may also be filled with the red color. In some instances, center 88 of hopper 22 shown in upper right section 86 of display 62 may additionally be filled with the red color when dipper body 44 and/or dipper door 46 have the potential to collide with hopper 22. Any time that the red color is shown in display 62, warning device 64 may be selectively activated.

Figure 6:
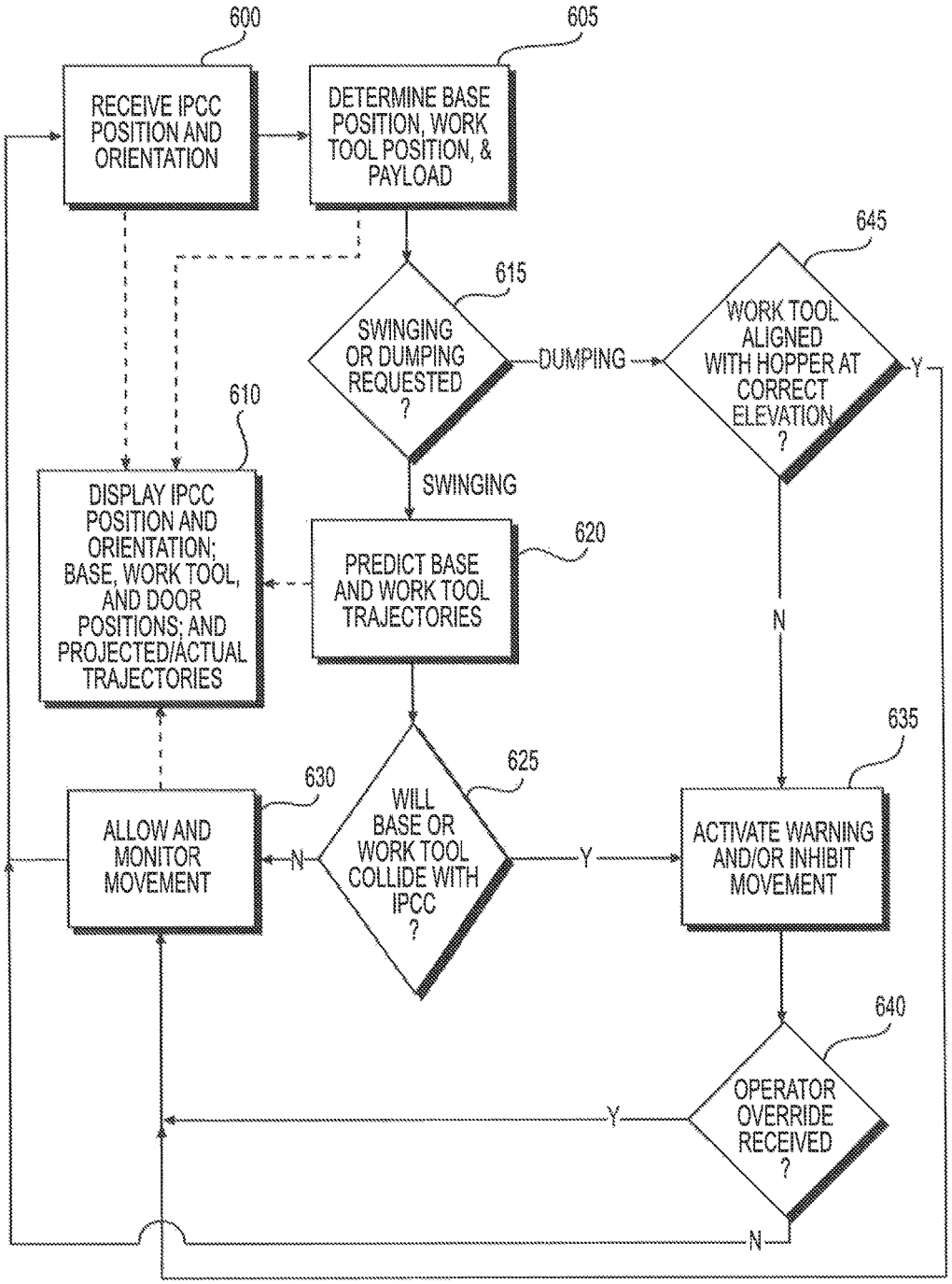
FIG. 6 is a flowchart depicting an exemplary disclosed method that may be performed by the excavation system of FIG. 3.

FIG. 6 illustrates a method of automated control that may be implemented by system 58. FIG. 6 will be discussed in greater detail below to further illustrate the disclosed concepts.

INDUSTRIAL APPLICABILITY

The disclosed excavation system may be used at any worksite to help regulate the interactions between an excavation machine and an IPCC. The disclosed excavation system may help to improve accuracy, productivity, and efficiency, by facilitating positioning of the IPCC prior to start of a repetitive excavation cycle. The disclosed excavation system may also facilitate improved cycle time, convenience, and profitability by providing operators of the excavation machine and/or the IPCC with instructions, recommendations, and/or visuals regarding machine interactions. Operation of excavation system 58 will now be described in detail, with respect to FIG. 6.

During operation of system 58, controller 70 of excavation machine 12 may receive the position and orientation of IPCC 14 (Step 600). The position and orientation may be determined by location device 59 onboard IPCC 14, and transmitted to controller 70 of excavation machine 12 via communication devices 60. Controller 70 of excavation machine 12 may simultaneously determine the position of base 28 and work tool 20, and a payload of work tool 20 (Step 605). The position of base 28 may be determined by location device 59 onboard excavation machine 12, while the position of work tool 20 may be calculated by controller 70 as a function of the base position and known kinematics of excavation machine 12. The payload may be determined by controller 70 based on signals generated by one or more of sensors 68. The position information associated with the two machines, as well as the payload information, may be directed to display 62 onboard excavation machine 12 and/or display 62 located onboard IPCC 14 (Step 610).

Controller 70 of excavation machine 12 may continuously monitor operator input to determine if swinging or dumping of work tool 20 has been requested (Step 615). This input may be received by way of one or more of input devices 66 located within excavation machine 12. In some embodiments, this input may additionally or alternatively be generated by controller 70 during autonomous control of excavation machine 12.

When the input received from device(s) 66 indicates that a swinging operation is desired (Step 615: Y), controller 70 may predict a trajectory of base 28 (i.e., of the counterweight portion of base 28) and of work tool 20 (Step 620). These trajectories may be predicted by controller 70 using any known algorithms and based on the positions of these components determined at step 605 and commanded, monitored, and/or requested speeds, forces, directions, extensions, spool lengths, angles, elevations, etc. In some embodiments, the predicted trajectories may also be shown on displays 62 of one or both machines (i.e., step 620 may feed step 610, in some embodiments).

After completion of step 620, controller 70 of excavation machine 12 may determine if the predicted trajectories of excavation machine 12 will cause base 28 and/or work tool 20 to collide with any portion of IPCC 14 (Step 625). Controller 70 may make this determination based on a comparison of the trajectories predicted in step 620 with the known position and orientation of IPCC 14 determined in step 600. If collision of excavation machine 12 with IPCC 14 is unlikely (Step 625: N), controller 70 may allow and monitor the actual swinging motion of excavation machine 12 (Step 630). The monitored movement may be sent to one or both of displays 62 (i.e., the monitored actual motion may feed into step 610). After completion of step 630, control may return to step 600.

However, if during the completion of step 625, controller 70 determines that the predicted trajectories of base 28 and/or work tool 20 will likely pass through the known location of IPCC 14 (Step 625: Y), controller 635 may activate warning device 64 (Step 635). In addition, controller 70 may inhibit the associated movement of excavation machine 12, in some embodiments. Controller 70 may inhibit the movement of excavation machine 12 by not relaying requested movements received via input devices 66 to the corresponding actuators (e.g. to drum winches, swing motors, crowd cylinders, etc.), and/or by locking out or otherwise braking a particular function. When this happens, the operator may be given the opportunity to override controller 70 and initiate the movement, regardless of the potential for collision. For example, controller 70 may cause an instruction to be shown on display 62, informing the operator that the requested movement has been inhibited and asking the operator if override is desired. The operator may respond via manipulation of input device 66 and/or display 62. Controller 70 may monitor operator input after movement inhibition to determine if the override is received (Step 640). If the override is received, control may pass to step 630. Otherwise, control may pass from step 640 to step 600.

Returning to step 615, when controller 70 determines that dumping is desired instead of swinging, controller 70 may determine if work tool 20 is properly aligned with hopper 22 (Step 645). For example, controller 70 may determine if center 88 of work tool 20 is vertically aligned with center 80 of hopper 22 and if work tool 20 is located at a distance sufficiently high above hopper 22 such that dipper door 46 will not collide with hopper 22 when opened. Controller 70 may determine if these conditions are present based on a comparison of the information obtained during steps 600 and 605. When work tool 20 is aligned with hopper 22 and located at a desired elevation above hopper 22, control may proceed from step 645 to step 630. Otherwise, control may instead proceed from step 645 to step 635.

It will be apparent to those skilled in the art that various modifications and variations can be made to the excavation system of the present disclosure without departing from the scope of the disclosure. Other embodiments will be apparent to those skilled in the art from consideration of the specification and practice of the embodiments disclosed herein. For example, although some functions of system 58 have been described as being performed by two separate controllers 70, it is contemplated that a single controller could alternatively be used to perform the same or similar functions. It is intended that the specification and examples be considered as exemplary only, with a true scope of the disclosure being indicated by the following claims.

What is claimed is:

1. An excavation system for use with an excavation machine having a work tool and with an IPCC, the excavation system comprising:

a location device mountable onboard the excavation machine and configured to generate a first signal indicative of a location of the excavation machine;

a display; and at least one controller in communication with the location device and the display, the at least one controller being configured to:

receive a second signal indicative of a location of the IPCC;

cause representations of the excavation machine and the IPCC to be simultaneously shown on the display based on the first and second signals;

determine a swing radius of the work tool;

receive a desired loading position on the swing radius for the IPCC;

selectively cause an indication of alignment between the IPCC and the desired loading position to be shown on the display with the simultaneously shown representations of the excavation machine and the IPCC based on the received desired loading position; and selectively cause an indication of alignment between the IPCC and the swing radius to be shown on the display, with the simultaneously shown representations of the excavation machine and the IPCC and the indication of alignment between the IPCC and the desired loading position, based on the first signal, the second signal, the determined swing radius, and the received desired loading position.

2. The excavation system of claim 1, further including at least a first sensor mountable onboard the excavation machine and configured to generate a third signal indicative of loading of the work tool, wherein the at least one controller is further configured to selectively cause an indication of loading of the IPCC to be shown on the display based on the third signal.

3. The excavation system of claim 2, wherein the at least one controller is further configured to:

receive a fourth signal indicative of a rate of material being transported away from the IPCC; and selectively cause the indication of loading of the IPCC to be shown on the display based also on the fourth signal.

4. The excavation system of claim 2, wherein:

the display is mountable onboard the excavation machine; and the at least one controller is further configured to selectively cause the indication of loading of the IPCC to also be shown on the display.

5. The excavation system of claim 1, wherein:

the work tool has a door hinged to move toward the IPCC at a start of a dumping operation; and the at least one controller is further configured to:

predict a location of the door when opened; and selectively cause the predicted location of the door when opened to be shown on the display.

6. The excavation system of claim 5, wherein the at least one controller is further configured to generate a warning when opening of the door is predicted to result in collision with the IPCC.

7. The excavation system of claim 1, further including an input device configured to receive input from an operator indicative of a desire to cause swinging of the work tool toward the IPCC, wherein the at least one controller is further configured to:

make a prediction of a trajectory of the work tool during the swinging based on the first signal and known kinematics of the excavation machine;

determine a potential for collision of the work tool with the IPCC based on the prediction, the second signal, and known kinematics of the IPCC; and selectively generate a warning based on the potential.

8. The excavation system of claim 7, wherein the at least one controller is further configured to selectively inhibit the swinging of the work tool when the prediction indicates that collision of the work tool with the IPCC may occur.

9. The excavation system of claim 8, wherein the at least one controller is further configured to:

receive operator input indicative of a desire to override the at least one controller; and selectively allow the swinging of the work tool based on the operator input regardless of the prediction.

10. The excavation system of claim 1, further including at least one sensor configured to generate a third signal indicative of movement of the excavation machine, wherein the at least one controller is further configured to selectively cause a representation of alignment of the work tool with the IPCC to be shown on the display based on the first signal, the second signal, the third signal, and known kinematics of the excavation machine and the IPCC.

11. The excavation system of claim 10, wherein the representation of alignment includes a first representation of the work tool and a second representation of a hopper of the IPCC.

12. The excavation system of claim 11, wherein at least one of the first and second representations changes color based on a level of the alignment.

13. The excavation system of claim 1, wherein the display is mountable onboard the IPCC and usable to maneuver the IPCC to align the IPCC with the swing radius.

14. The excavation system of claim 1, wherein the display is mountable onboard the IPCC and usable to maneuver the IPCC to align the IPCC with the desired loading position.

* * * * *